299-13 SR

3/22/83 OR 4,377,310

United States Patent [19]

Gubin et al.

[11] 4,377,310

[45] Mar. 22, 1983

[54] METHOD OF UNDERGROUND WORKING OF ORE DEPOSITS AND HANDLING ORE

[76] Inventors: Ivan P. Gubin, ulitsa Sechenova, 23, kv. 44; Sergei G. Machavariani, ulitsa M. Toreza, 113, kv. 8, both of Novokuznetsk Kemerovskoi oblasti; Nikolai S. Efremovtsev, Nakhimovsky prospekt, 25/1, kv. 51, Moscow; Viktor A. Kovalenko, prospekt Metallurgov, 25, kv. 128; Alexandr V. Mozolev, prospekt Suvorova, 5, kv. 6, both of Novokuznetsk Kemerovskoi oblasti; Sergei I. Nikolaev, ulitsa Lenina, 3, kv. 20, Nizhny Tagil Sverdlovskoi oblasti; Georgy I. Nikolaev, prospekt Stroitelei, 2, kv. 12, Kushva Sverdlovskoi oblasti; Viktor A. Guriyanov, ulitsa M. Toreza, 86 "A", kv. 22, Novokuznetsk Kemerovskoi oblasti; Anatoly I. Temnikov, ulitsa Astrakhanskaya, 4, kv. 3, Perm; Evgeny E. Tyryshkin, 13 mikroraion, 12, kv. 101, Novokuznetsk Kemerovskoi oblasti; Nikolai G. Dubynin, ulitsa Krasnaya, 5, kv. 78, Kemerovo; Volf Z. Kogan, ulitsa Astrakhanskaya, 4, kv. 6, Perm; Anatoly P. Ljubkin, ulitsa Kirova, 75, kv. 115; Anatoly P. Sedko, ulitsa Bardina, 5, kv. 10, both of Novokuznetsk Kemerovskoi oblasti, all of U.S.S.R.

[21] Appl. No.: 147,199

[22] Filed: May 6, 1980

[51] Int. Cl.[3] ..... E21C 41/06

[52] U.S. Cl. ..... 299/13; 198/750; 299/18

[58] Field of Search ..... 299/13, 18

[56] References Cited

U.S. PATENT DOCUMENTS

| | | | |
|---|---|---|---|
| 968,100 | 8/1910 | Washburne | 299/18 X |
| 2,298,599 | 10/1942 | Smith | 299/18 |

FOREIGN PATENT DOCUMENTS

| | | | |
|---|---|---|---|
| 444886 | 9/1974 | U.S.S.R. | 299/18 |
| 456913 | 3/1975 | U.S.S.R. | 299/18 |

OTHER PUBLICATIONS

Perfecting the Stoping Technology in the Shereghesh-skaiya Mine UDC 622.23.002.2.002.237.

*Primary Examiner*—Ernest R. Purser
*Attorney, Agent, or Firm*—Lilling & Greenspan

[57] ABSTRACT

A distinction of the method is that, at the moment of release of ore, the ore flow in the zone of an outlet opening is divided into at least two parts by a vertical plane, and the ore flow is caused to swing transversely with respect to the direction of ore flow by alternately changing the density of ore in the portions of the flow. Oversized lumps of ore delivered to a loading drift are transferred along a ramp by-passing haulage vehicles to ventilating and man roads which are arranged at the level of haulage crosscuts and connected thereto at points opposite to the loading drifts. An apparatus for carrying out the method includes a working surface of a platform having three rigidly interconnected portions, the end portions extending parallel and at different levels, and a central portion inclined in the direction of ore flow.

1 Claim, 8 Drawing Figures

METHOD OF UNDERGROUND WORKING OF ORE DEPOSITS AND HANDLING ORE

FIELD OF THE INVENTION

The invention relates to the mining industry and, more particularly, to the stopping of ore in the underground working of thick steep ore bodies.

The main requirements imposed on methods for underground working with blasting of ore is the provision of a continuous flow production method for the release of ore from blocks. To comply with this requirement, it is necessary that an ore delivery method enable an increase in the effective cross-section of an outlet opening to a size corresponding to any size of ore broken by mass blasting under the underground mining conditions. A system which is to comply with the release method requirements should be suitable for operation under a compressed pile of ore.

DESCRIPTION OF THE PRIOR ART

Widely known in the art is a method for mining with block caving of thick steep iron ore bodies (cf. V. A. Kovalenko et al., Improvement in Production Method for Stoping Operations at Sheregeshskaya Mine, FIG. 1 (in Russian), Gorny Zhurnal No. 9, 1977), comprising a crosscut preparation of bottom with loading drifts, a screening level designed for secondary crushing of oversized lumps being arranged 10–12 m above a haulage level and being connected by means of ore chutes to loading drifts for feeding normal size ore from the screening level to the haulage crosscut. By this mining method ore is delivered from blocks to ore chutes through screens installed over the ore chutes with subsequent loading of normal size ore from the ore chutes in haulage vehicles by means of hatches or vibratory feeders.

The advantage of the above-described method resides in that the chutes with normal size ore constitute an accumulating space separating the release from the loading. The degree of influence of non-uniform release on loading process is thus reduced. With the use of such method the equipment employed for the mechanization of ore loading from the ore chutes cannot, however, have any effect on the delivery process which is conducted at the screen level manually using shovelling and blasting, thus affecting the release efficiency and limiting the performance at loading operations which does not exceed 600 t/day (from three ore chutes connected with one loading point).

A modification of the mining method with sublevel breakage is widely used in the mining industry around the world, wherein the release process at sublevels is mechanized by means of self-propelled loading and haulage vehicles and the process at the haulage level at ore chutes is also mechanized by using high-capacity stationary loading machines. In this modification of the mining method the level is subdivided into 5–6 sublevels each 9 to 12 m high. Ore is transferred from the sublevels along ore chutes to the haulage level where it is loaded into haulage vehicles. The capacity of normal size ore loading from the ore chutes by this method is 3–4 times higher and is up to 2000 t/day due to an increase in the number of faces per one ore chute. Release efficiency remains, however, at the same level compared to a gravity ore release through screens. This is due to the fact that with the sublevel breakage the reserves of broken ore at one face is not enough for a shift.

Therefore, during one shift, in addition to the ore release, drilling and blasting should be made, thus lowering the output for one face to 200 t/day.

The above-described modification of the method of working with sublevel breakage has the following disadvantages compared to the method of mass breakage over the entire level height;

1. Large volume of driving operations for the preparation of sublevels and ore chutes.

2. The need of having a team of drill operators, blasters and loading machinists at each sublevel.

Another modification of the method for mining with level breakage has been recently developed (cf. V. A. Kovalenko, Improvement in Production Method for Stoping Operations at Sheregeshskaya Mine, FIG. 2 (in Russian), Gorny Zhurnal, No. 9, 1977) which is free from the disadvantages of the abovedescribed modifications of the methods. It comprises a crosscut preparation of bottom with loading drifts accommodating devices for release and loading of ore, using for controlling of release and secondary crushing ventilating and man roads arranged in an intercrosscut pillar above the roof level of loading drifts and communicating through inclined man ways with delivery ways for an access to chokes of ore therein, secondary crushing and ventilating. In this modification of the method for mining with mass breakage of ore the release and loading processes are effected by means of one and the same arrangement (vibratory feeder). One operator can at the same time make the loading and supervise the release of ore and also eliminate chokes and effect secondary crushing of oversize ore. The absence of an accumulating space for normal size ore results, however, in an increased influence of non-uniform release on the loading capacity which does not exceed than 600 t/shift. Non-uniformity of release depends on the number of chokes of ore in an outlet opening which are formed with the release of oversized ore, as well as with the release of normal size ore as a result of mismatch between the size of the effective cross-section of the outlet opening and the size of the ore which is released after a mass blasting. This mismatch is the main disadvantage of all the known methods of ore release and it restrains the development of a continuous production flow method of release and loading of ore from blocks.

The possibility of increasing the size of the effective cross-section of the outlet opening and matching it with the size of ore which is broken at present by mass blasting in the underground mining depend on methods and devices for release of broken ore.

Known in the art is a gravity method of ore delivery using scrapers and scraper conveyors. Using such devices blasted ore fines are removed from an ore slope extending from the outlet opening to the floor of a loading drift, thereby clearing the way for an ore flow. The height of the flow at the narrowest point at the fore-end of the outlet opening ranges from 0.7 to 0.9 m. In this case the maximum size of ore released without choke does not exceed 300–400 mm which is three times smaller than normal size of ore that can be handled by modern underground crushers. As a result a large number of chokes are formed—up to 16–20—per 1000 tons of released ore. The base for the formation of choke archings is provided by a stationary zone of ore which restricts the size of effective cross-section of the outlet opening. The main disadvantage of the gravity ore release method is the lateral arrangement of delivery drifts relative to a scraping race the equipment employed for the mechanization of release cannot influence this stationary zone. Therefore, all unstable chokes should be removed manually by shovelling, thus lowering the output at the delivery and creating hazordous situations when a miner approaches chokes.

Recently the gravity method of ore release is being replaced by a semiactive method of release using self-propelled loading and haulage vehicles, various feeders and other release arrangements enabling end-face recovery of ore from release drifts. As differed from the gravity delivery, the process of ore outflow from the outlet opening in this delivery method is of a double nature.

Before chokes are formed the ore flow behaves as in the case of the gravity release method. As the ore slope extending from under the fore-end of the outlet opening and located under the protection of a haulage drift roof is being retracted, the outlet opening is opened and the ore flow tends to move thereto at a point of the lowest resistance, adjacent to the fore-end of the outlet opening. The stationary ore zone, similarly to the gravity method, constitutes a "bed" for the ore flow and restricts the size of the effective cross-section of the outlet opening.

After a choke is formed the stationary zone is exposed and may be acted upon by mechanical devices. During this period of active working on the stationary zone unstable chokes are removed, and the size of released ore is two times larger—up to 600–800 mm due to the destruction of that part of the stationary zone which is under the protection of choke which is 1.5 times smaller than the normal size lump. So even in case of the semiactive method there is the need in a secondary crushing of normal size ore in eliminating chokes by blasting. 95% of oversized ore lumps are crushed in eliminating chokes in the outlet opening.

Therefore, the main disadvantage of known release methods is the presence of a stationary zone which limits the possibility of an increase in the size of the effective cross-section of the outlet opening to match it with the size of ore lumps broken during underground mining. Mismatch of the size of the effective cross-section of the outlet opening with the size of released ore which results in choking in the outlet opening restrains further increase in the productivity of known release methods and constitutes a major obstacle on the way to the development of an automatic flow production line for ore release from blocks.

The disadvantages of known release methods can be best illustrated with reference to operation of apparatus used for their realization.

In ore release by means of loaders having scooping or raking operating units the amount of penetration of an operating unit into a pile does not exceed 1.5 m. In this case the height of ore flow moving from under the fore-end of the outlet opening, as with the gravity release using scrapers, does not exceed 0.9 m. During this period, before choke is formed, the character of the ore flow movement over the stationary zone does not differ from that of the gravity flow, and the size of ore lumps released without choking does not exceed 400 mm.

During the period after the formation of chokes, when the stationary zone becomes exposed, self-propelled equipment can be used for ore recovery from the stationary zone. This is equal to an increase in the depth of ore recovery from under the pile, thus enabling an increase in the size of the effective cross-section of the outlet opening and size of released ore. This amount of the ore recovery depth with the delivery using self-propelled equipment does not, however, exceed the length of the base of an ore slope extending from under the fore-end of the outlet opening to the bottom of a loading drift. Further increase in the penetration depth of an operating unit is limited by the following:

danger of moving a machine under a choke; and difficulties of penetration of an operating unit into a compacted ore which is behind the fore-end of the outlet opening under the broken mass.

Feeders of all types are preferred compared to self-propelled equipment when using the semiactive method of release from the viewpoint of the possibility of a safe increase in the ore recovery depth.

During the period before the formation of chokes, feeders ensure the ore recovery depth equal to the length of the base of an ore slope extending to the working web of a feeder which is the maximum ore recovery depth for self-propelled equipment.

After the formation of a choke, feeders provide further increase in the ore recovery depth beyond the limits of the fore-end of the outlet opening owing to the ore intake from that part of the stationary zone which is under the protection of the choke arching. The size of released ore is 1.5 times larger compared to that released with self-propelled equipment and is as large as 0.9 m.

Further increase in the recovery depth and size of ore delivered by feeders is, however, limited by the following:

when vibratory feeders having an elastic system and directional oscillations are dipped in excess directly beneath the stationary zone, the elastic system of a vibratory platform is jammed thus causing an intensive reduction of vibratory power towards the jammed end;

feeders without an elastic system having a flexible vibratory platform are not sensitive to an excessive dipping, but with these feeders oscillations of the vibratory platform are damped in the direction from a vibrator to the stationary zone and;

feeders of the type with conveyors of an endless belt are capable of transmitting a force over a certain distance for the destruction of the stationary zone. As the depth of penetration of the operating unit into the stationary zone increases, the head of the stationary zone acting on the ore flow becomes stronger which is accompanied by a decrease in the thickness of ore flow, and when the web is dipped 1.5–2 mm behind the fore-end of the outlet opening, the ore flow is completely constricted and stopped.

In accordance with technological capabilities of known feeders, it is generally recommended to dip the operating unit of a feeder directly under the broken mass (behind the fore-end of the outlet opening) maximum at 1 m. Maximum height of the ore flow at the narrowest adjacent to the fore-end of the outlet opening does not exceed 1.5 mm and maximum size of ore lumps released without choking is 1 m.

SUMMARY OF THE INVENTION

The main object of the invention is to improve the method for underground working of ore deposits by modifying the production sequence of the release and loading process by transferring secondary crushing operations from the delivery drifts to the haulage cross-cut in ventilating and man roads.

Another object of the invention is to provide ore delivery without choking by eliminating the stationary zone which limits the size of the effective cross-section of the outlet opening.

Still another object of the invention is to provide a system for the realization of the above-described release method, which is capable of reliably operating under heavy conditions under a heap of ore.

These and other objects are accomplished by a method for underground working of ore deposits comprising driving mining galleries, blasting, and conducting delivery and loading of ore to haulage vehicles. According to the invention, an ore flow in the zone of an outlet opening is divided by a vertical plane into at least two parts and is caused to swing transversely with respect to the direction of ore flow by alternately changing ore density in the parts of the flow. Oversized lumps of ore delivered into the loading drift are transferred along a ramp by-passing haulage vehicles to ventilating and man roads which are arranged at the level of bottom of haulage crosscuts and connected thereto at points opposite to the loading drifts.

The objects are also accomplished by an apparatus for the realization of the method, comprising a frame on which is installed by means of support members a platform for receiving ore fed from the outlet opening, and a drive for imparting reciprocations to the platform relative to the frame. According to the invention, the working surface of the platform is made of three rigidly interconnected portions, the end portions extending parallel to the direction of reciprocations of the platform and being arranged at different levels, and the central portion of the platform being inclined in the direction of ore flow.

The support members of the apparatus preferably comprise rolls with two flanges and three contact surfaces. The free end of the top portion of the platform is provided with a rigidly secured plate and a horizontal landing integral with the frame of the apparatus is arranged over the plate.

DETAILED DESCRIPTION OF THE INVENTION

The invention materially resides in the following.

The method for underground working of ore deposits, according to the invention, is based on a continuous production process of release of ore from blasted mass to haulage vehicles.

Continuous process of release is ensured by eliminating the stationary zone limiting the effective cross-section of the outlet opening, so that the size of the effective cross-section should be matched with the size of ore broken by mass blasting during underground mining.

Difficulties in increasing the size of the effective cross-section of the outlet opening are caused, because, during the release, ore passes at the point of the lowest resistance and forms a flow at the fore-end of the outlet opening. The remaining mass of ore which is beneath the flow remains stationary and forms a "bed" for the ore flow. Ore fines in the flow fall between the lumps of the ore "bed" to fill the free space therebetween so that density of ore in the stationary zone increases to such an extent that it cannot practically be destructed by any mechanical equipment employed for delivery and is to be blown-up by pressure charges in eliminating chokes when the stationary zone is exposed. After the stationary zone is destructed, the process of its formation and compaction is repeated.

Experimental studies have been conducted and it has been found that:

1. Formation of a stationary zone begins simultaneously with the formation of an ore flow, and the process of compaction of ore in this zone starts from the lower layers and continues as ore fines fill the space between ore lumps to the level of a boundary separating the stationary zone from the ore flow.

2. The process of ore compaction in the stationary zone may be prevented by loosening the lower layer of the stationary zone with subsequent recovery thereof with ore fines that get to this layer from the ore flow. The loosening of the lower layer of the stationary zone and its recovery from beneath the pile may be effected, for example, by means of that portion of the reciprocating platform which is under the outlet opening in the base of the stationary zone and which is inclined in the direction of ore flow. During the return stroke of the platform (opposite to the direction of ore flow) its inclined portion, which functions similarly to a wedge, retracts from beneath the base of the stationary zone, thus vacating the space for loosening the lower layer of the zone. During the forward stroke this loosened layer, which is of the same density as the ore flow, is caused to move together with the platform into the loading drift beyond the fore-end of the outlet opening where it merges with the ore flow, the top portion of the stationary zone being loosened and descending to the vacated space thereunder.

3. The formation of the stationary zone may be prevented before it is compacted by dividing the ore flow by a vertical plane in the zone of the outlet opening and by swinging the ore flow transversely with respect to the flow direction by alternately changing ore density in the portions of the flow. The process of swinging the ore flow and prevention of the formation of the stationary zone may be effected, for example, by imparting reciprocations to the platform. When the platform moves forward (in the direction of ore flow) a column of ore which is on the platform is shorn off at the fore-end level of the outlet opening so that ore is compacted in the front end portion of the outlet opening by a force which is equal to the force shearing the ore column, the ore in the rear end portion of the outlet opening being loosened due to the compaction of ore in the front end portion, and the ore flow is formed due to the descent of denser layer of overlying ore to this loosened zone. When the platform moves rearward, ore is compacted in the rear end portion of the outlet opening by a force which is equal to the force of cohesion of ore to the platform surface, and ore is loosened in the front end portion of the outlet opening. Thereafter the inclined portion of the platform lowers a batch of ore in the loosened part of the flow at the fore-end of the outlet opening. By continuously repeating the change in ore density in the front end and rear end portions of the outlet opening and by alternately releasing ore in these portions, the ore flow is caused to swing transversely with respect to the flow direction, thereby preventing the formation of a stationary zone. Ore uniformly descends over the whole dipped portion of the operating unit and the depth of ore recovery from the ore pile is equal to the depth of penetration of the operating unit of the apparatus, so that new opportunities are provided for an increase in the size of the effective cross-section of the outlet opening and for matching it with the size of ore broken in underground mining at present.

Continuous flow process of delivery and loading is enabled by modifying the production sequence of delivery and loading by transferring secondary crushing operations to the last stage after ore loading so that continuous loading and independence of the loading process of the yield of oversized ore are ensured. Oversized lumps delivered to the loading drift are separated from the ore flow without interrupting the loading process and are transferred along a ramp to ventilating and man roads by-passing haulage vehicles, where they are subjected to secondary crushing with removal of crushed ore after loading.

Independence of secondary crushing of oversized lumps and removal of crushed lumps are enabled by chaging the arrangement of ventilating and man roads driven at the level of haulage crosscuts and connected thereto at points opposite to the loading drifts.

A difficulty in operation of apparatus for delivery which enable an increase in the effective cross-section of the outlet opening to a size corresponding to the size of delivered ore mainly, is that, as the depth of penetration of a operating unit of the apparatus into the pile increases, the access is restricted for adjustment and lubrication of the platform rolling supports and for removal of ore fines spilled through the space between the frame and the movable platform in the rear end portion thereof which is deep in the ore pile.

In order to eliminate the need to adjust and lubricate the rolling supports, they comprise rolls with two flanges and three contact surfaces providing for a permanent contact with upper and lower tracks upon misalignment of the platform.

To eliminate spillage of ore fines through the space between the frame and the movable platform at the rear end portion thereof which is deep in the ore pile, a plate is rigidly secured to the free end of the top portion of the platform, and a horizontal landing integral with the frame of the apparatus is provided over the plate.

A varying depth pocket is thus defined in which the rear wall is formed by the plate secured to the end of the platform and moving therewith. During the return stroke of the platform the pocket depth increases at a rate equal to the rate of ore income into the pocket, so that the ore cannot reach the space which is in the upper portion of the pocket between the rear wall of the pocket and the horizontal landing.

The use of the method for underground working of ore deposits, according to the invention, enabling a continuous flow of release and loading of ore from the blasted mass to haulage vehicles, enables:

1. fourfold increase in the throughput capacity of a loading station (crosscut) up to 2500 t/shift;

2. two-threefold increase in size of ore released without choking up to 1800–2400 mm;

3. two-threefold reduction of time for the preparation of stoping blocks by reducing the volume of blasthole operations due to an increase in ore lump size;

4. 1.5 times reduction of specific consumption of explosives for primary breakage owing to enlarged spacing of blastholes and reduction of specific consumption of explosives for secondary crushing due to 16–20 times reduction of the number of chokes in the outlet opening;

5. an increase in the ore loading performance per one outlet opening up to the level of throughput capacity of an ore chute to which normal size ore is transferred from 5–6 sublevels using self-propelled haulage equipment;

6. two-threefold reduction of losses and contamination of ore by providing the possibility of forming a mine ore flow at the delivery pace without detrimental effects at the haulage level due to an increased throughput capacity of the loading station (one outlet opening) which is up to the level of the throughput capacity of the loading station (crosscut) having 10–15 loading points;

7. simplified structure of block bottom and 1.5 times shorter time for its preparation owing to the arrangement of ventilating and man roads at the haulage level so that self-propelled equipment can be efficiently used;

8. eight-tenfold reduction of time for the preparation for drilling and blasting operations due to the use of ventilating and man roads (together with the haulage crosscuts) at a drilling level;

9. two-three fold reduction of time for opening and preparation of levels by increasing the height of the level due to an increase in the throughput capacity of haulage levels and reduced number thereof, which is required for obtaining a pre-set output of a mine; and 10. improvement safety of most difficult process of ore delivery from blocks due to the transfer of secondary crushing operations from the delivery drifts to the haulage level in ventilating and man roads.

BRIEF DESCRIPTION OF THE DRAWINGS

Other objects and advantages of the invention will become more apparent from the following description of an embodiment of the method according to the invention.

Better understanding of the invention may be had from the description which follows with reference to the accompanying drawings, in which.

DETAILED DESCRIPTION OF THE APPARATUS

Figure 1:
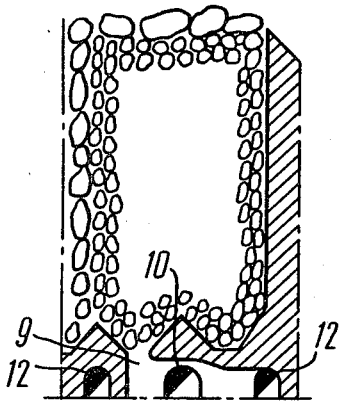
FIG. 1 is an elevational section of an ore body.
Figure 2:
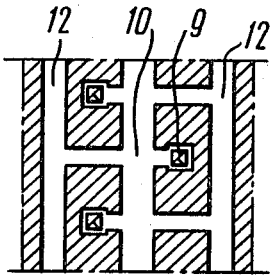
FIG. 2 is a plan view of a haulage level.
Figure 3:
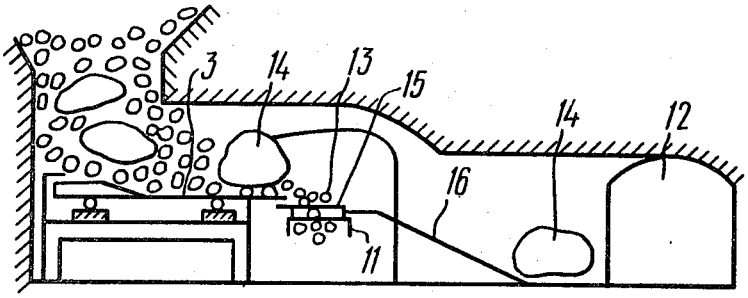
FIG. 3 is a diagrammatic view showing separation of oversized lumps from an ore flow and their transfer to ventilating and man roads.
Figure 4:
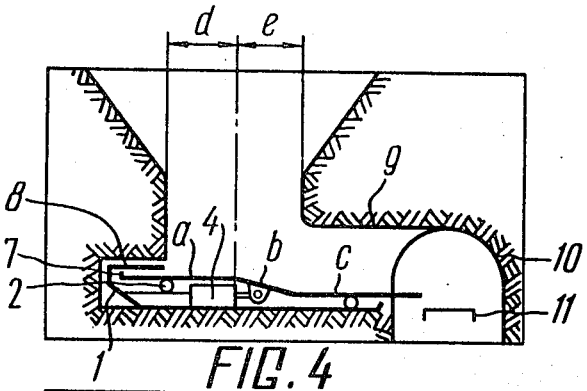
FIG. 4 is a longitudinal section of an outlet opening and an apparatus for carrying out the method shown at the moment before ore delivery starts.
Figure 5:
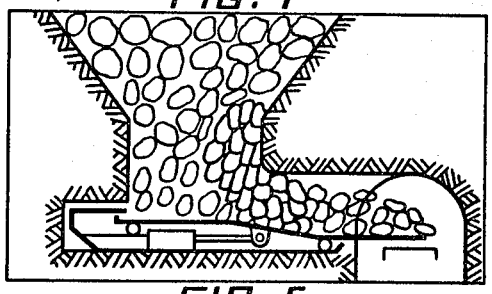
FIG. 5 is a view similar to that shown in FIG. 4, but at the moment of loosening of the rear end part of the ore flow and compaction of the front end part thereof.
Figure 6:
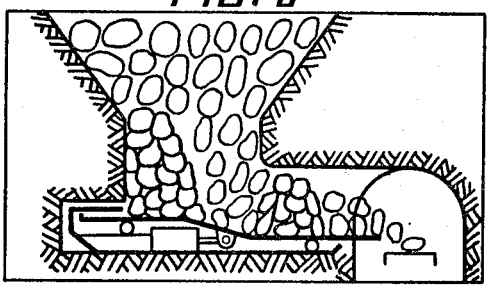
FIG. 6 is a view similar to that shown in FIGS. 4 and 5, but shown at the moment of loosening of the front end portion of the ore flow and compaction of the rear end portion thereof.
Figure 7:
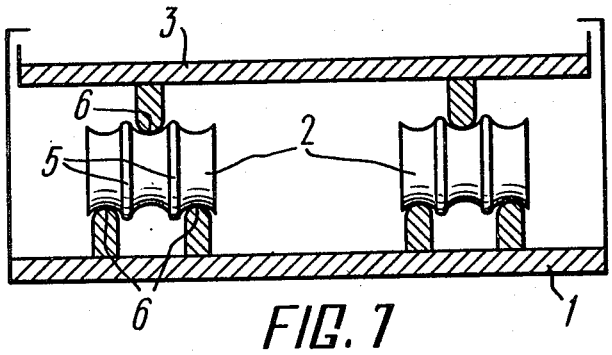
FIG. 7 is a transverse section of the apparatus across support members.

An apparatus for carrying out the method comprises a frame 1 on which by means of support members 2 is installed a platform 3 for receiving ore fed from an outlet opening, and a drive 4 imparting to the platform 3 reciprocations relative to the frame 1. The platform 3 consists of three rigidly interconnected portions "a", "b" and "c". Two end portions "a" and "c" of the platform 2 extend parallel with the plane of its movement and are arranged at different levels, and the central portion "b" is inclined in the direction of ore flow. The support members 2 of the platform 3 comprise rolls having two flanges 5 and three contact surfaces 6. The free end of the portion "a" of the platform 3 is provided with a rigidly secured plate 7 which prevents spillage of ore fines. A horizontal landing 8 integral with the frame 1 is arranged over the plate 7. The apparatus is installed under an outlet opening having a fore-end. The outlet opening is connected by means of a loading drift 9 to a crosscut 10 in which there are haulage vehicles 11. Conventional cars are used as haulage vehicles 11. At the opposite end of the crosscut 10, opposite to the loading drift 9, is provided a ventilating and man road 12. Ore flow in the zone of the outlet opening is divided conventionally into two parts "d" and "e". Ore compaction zones in these parts are drawn darker (FIGS. 4,5,6). The ore flow passing through the outlet opening contains normal size ore lumps 13 and oversized ore lumps 14. A screen 15 and a ramp 16 are provided over the haulage vehicles 11 for feeding oversized ore lumps 14 to the ventilating and man roads 12.

The ore deposit is worked in the following manner. Various galleries are made in the ore body, such as the haulage crosscut 10, loading drifts 9 and ventilating and man roads 12 which are driven at the level of the crosscut 10 and connected thereto at points opposite to the loading drifts 9. Ore is broken and delivered through the outlet opening into the loading drift 9 in which there is installed the apparatus for loading the broken mass of ore. The ore flows under gravity to the platform 3 of the apparatus. The inclined portion "b" of the platform 3 compacts the ore in the front end portion "e" of the ore flow due to the forward movement of the platform 3 under the action of the drive 4 toward the haulage crosscut 10. When the inclined portion "b" of the platform 3 moves from the position shown in FIG. 4 into the position shown in FIG. 5, a column of ore which is on the portion "b" is shorn off at the fore-end level so that a compacted layer of ore is formed at the fore-end (FIG. 5). Further movement of the portion "b" of the platform 3 toward the haulage crosscut 10 enables the transfer of a batch of ore from under the compacted layer to the haulage vehicles 11, and additional lowering of density occurs at the same time in the rear end portion "d" of the ore flow and the ore descends on the rear end portion "a" of the platform 3.

By moving the platform 3 by means of the drive 4 in the opposite direction lowering of density in the front end portion "e" of the ore flow is ensured due to an increase in density in the rear end portion "d" and then a batch of ore in less compacted portion "e" of the ore flow descends by means of the inclined portion "b" of the platform 3.

Figure 8:
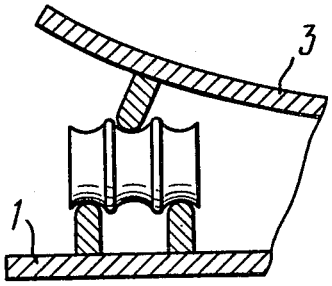
FIG. 8 shows the position of a support member at the moment of misalignment of the platform.

When reciprocations are imparted to the platform 3 the support rolls 2 roll over and engage with their surfaces 6 tracks of the platform 3 and frame 1. Protruding flanges 5 of the rolls 2 prevent the platform 3 from displacing laterally with respect to the direction of its movement. In case the platform 3 is misaligned under the action of the ore mass, the support member 2 changes its position and ensures a permanent contact with tracks of the platform 3 (FIG. 8).

Spillage of ore through the space between the horizontal landing 8 and the plate 7 of the platform is prevented due to the fact that the horizontal landing 8 and the plate 7 of the platform 3 define a varying depth pocket. When the platform 3 moves forward toward the haulage crosscut 10, the space between the horizontal landing 8 and the plate 7 does not reach the ore being conveyed. During the return stroke of the platform 3 the core is stationary and the platform slides away from beneath the ore. Only that portion of the ore which is within the pocket is moved by the platform 3. The ore cannot reach the space as the depth of the pocket increases at a rate equal to the rate of ore input to the pocket. By continuously repeating the steps of changing density of the ore flow in the portions "d" and "e" the ore flow is caused to swing transversely with respect to the direction of ore flow. The normal size ore lumps 13 are loaded into the haulage vehicles 11 through the screen 15 having a mesh size corresponding to the normal size lump, and the oversized ore lumps 14 that do not pass through the screen 15 roll down along the ramp 16 to ventilating and man roads 12. Separation of oversized ore lumps 14 from the ore flow and their transfer to the ventilating and man roads 12 occur without any interruption of the loading process, and secondary crushing and removal of crushed ore are made at any time convenient for such operations.

These operations enable more efficient release of ore which ensures, as differed from known methods, an increase in the size of the effective cross-section of the outlet opening and bring it in consistence with the size of ore broken in the underground mining conditions. The method is preferably carried out using the above-described apparatus, and the geometrical, and kinematic parameters of the apparatus should be necessarily matched with the parameters of the delivery process.

What is claimed is:

1. A method for underground working of ore deposits, comprising the steps of driving galleries; blasting; conducting release and loading of ore to haulage vehicles; during said release of ore, dividing ore flow in the zone of an outlet opening into at least two parts by a vertical plane and swinging said ore flow transversely to the direction of ore flow by alternately changing the density of ore in parts of the ore flow; transferring oversized lumps of ore released to a loading drift along a ramp, by-passing said haulage vehicles, to ventilating and man roads arranged at the level of floor of haulage crosscuts and connected thereto at points opposite to the loading drifts.

* * * * *